US005876030A

United States Patent [19]

Dobbertin et al.

[11] Patent Number: 5,876,030

[45] **Date of Patent: *Mar. 2, 1999**

[54] APPARATUS FOR FACILITATING HANDLING TAB STOCK IN A TOP FEED VACUUM CORRUGATED FEEDER

[75] Inventors: Michael T Dobbertin, Honeoye; Henry Paul Mitchell, Webster; James Douglas Shifley, Spencerport; Miguel A Triana, Rochester; Theophilus Casimir Wituszynski, Fairport, all of N.Y.

[73] Assignee: Eastman Kodak Company, Rochester, N.Y.

[ * ] Notice: This patent issued on a continued prosecution application filed under 37 CFR 1.53(d), and is subject to the twenty year patent term provisions of 35 U.S.C. 154(a)(2).

[21] Appl. No.: 642,380

[22] Filed: May 3, 1996

[51] Int. Cl.[6] ..... B65H 5/08

[52] U.S. Cl. ..... 271/13; 271/94; 271/98; 271/104; 271/160; 271/167; 271/169

[58] Field of Search ..... 271/98, 104, 160, 271/167, 169, 11–13, 94, 105, 106, 122

[56] References Cited

U.S. PATENT DOCUMENTS

| | | | |
|---|---|---|---|
| 4,887,805 | 12/1989 | Herbert et al. | 271/98 X |
| 4,974,035 | 11/1990 | Rabb et al. | 355/325 |
| 5,008,715 | 4/1991 | Imaizuni et al. | 355/309 |
| 5,019,839 | 5/1991 | Watanabe et al. | 355/309 |
| 5,029,838 | 7/1991 | Kunihiro | 355/309 |
| 5,135,213 | 8/1992 | Macachowski et al. | 271/104 |
| 5,150,892 | 9/1992 | Shimizu | 271/104 X |
| 5,245,397 | 9/1993 | Mahoney | 355/325 |
| 5,290,023 | 3/1994 | Sasaki et al. | 271/104 X |
| 5,344,133 | 9/1994 | Jantsch et al. | 271/94 |
| 5,347,350 | 9/1994 | Nakahata et al. | 355/309 |
| 5,359,402 | 10/1994 | Nakahata et al. | 355/309 |
| 5,730,439 | 3/1998 | Salomon | 271/122 |

FOREIGN PATENT DOCUMENTS

| | | | |
|---|---|---|---|
| 144670 | 11/1979 | Japan | 271/104 |
| 67343 | 4/1985 | Japan | 271/104 |

*Primary Examiner*—Boris Milef
*Attorney, Agent, or Firm*—Lawrence P. Kessler

[57] ABSTRACT

An apparatus for facilitating handling particularly tab stock in a sheet feeder, having a top feed vacuum corrugated feed head assembly for feeding sheets seriatim from a sheet supply stack. The facilitating apparatus includes a platform adapted to support a sheet supply stack of the tab stock type. A tab stock sheet supply stack is located on the platform in relation to the top feed vacuum corrugated feed head assembly. A force is applied to the tab stock sheet supply stack, such force having at least a component in a direction relative to such tab stock sheet supply stack to prevent individual tab stock sheets in such stack from prematurely moving out of control of the top feed vacuum corrugated feed head assembly.

3 Claims, 7 Drawing Sheets

APPARATUS FOR FACILITATING HANDLING TAB STOCK IN A TOP FEED VACUUM CORRUGATED FEEDER

BACKGROUND OF THE INVENTION

The present invention relates in general to feeding tabbed sheets from a stack of tab stock, and more particularly to an apparatus for handling tab stock in a top feed vacuum corrugated feeder.

In typical reproduction apparatus such as copiers or printers, for example, information is reproduced on individual cut sheets of receiver material such as plain bond paper or transparencies. Receiver sheets, of the various types, are stored respectively in a stack and fed seriatim when copies are to be reproduced. The sheet feeder for the reproduction apparatus must be able to handle a wide range of sheet types and sizes reliably and without damage. Sheets must be accurately fed individually from the sheet stack, that is, without misfeeds or multi-feeds.

One recently described highly efficient and reliable sheet feeder is shown in U.S. Pat. No. 5,344,133, issued Sep. 6, 1994, in the name of Jantsch et al. In such apparatus, a stack of sheets is stored in a supply hopper. A sheet feed head assembly, including a plenum, a vacuum source in flow communication with the plenum, and a mechanism, such as a feed belt associated with the plenum, urges a sheet acquired by vacuum in a sheet feeding direction away from the sheet supply stack. The sheet supply stack is supported so as to maintain the topmost sheet in such stack at a predetermined level in spaced relation with respect to the urging mechanism of the sheet feed head assembly. A first positive air supply directs a flow of air at the sheet supply stack to levitate the top several sheets in the supply stack to an elevation enabling the topmost sheet to be acquired by vacuum from the sheet feed head assembly plenum; and a second positive air supply directs a flow of air at an acquired sheet to assure separation of any additional sheets adhering to such topmost sheet.

With the advancement in the operative capabilities of reproduction apparatus, it has been desired to expand the types of receiver material which can be utilized in the reproduction apparatus. One of the expanded types of receiver material desired to be used is the type referred to as tab stock. Tab stock includes sheets having an even edge and an opposed uneven edge with a projection spaced along such uneven edge. The projection (tab), which for example can serve as a location for a label (pre-printed or printed by the reproduction apparatus), enables the sheet to separate or provide divisions in a copy set. Due at least in part to the projections, typical reproduction apparatus receiver sheet feeders have some difficulty in reliably feeding tab stock. While the feeder of the above described type reliably handles a wide variety of standard individual cut sheets of receiver material, it also does not readily accommodate tab stock.

SUMMARY OF THE INVENTION

In view of the foregoing discussion, this invention is directed to an apparatus for facilitating handling particularly tab stock in a sheet feeder, having a top feed vacuum corrugated feed head assembly for feeding sheets seriatim from a sheet supply stack. The facilitating apparatus includes a platform adapted to support a sheet supply stack particularly of the tab stock type. A tab stock sheet supply stack is located on the platform in relation to the top feed vacuum corrugated feed head assembly. A force is applied to the tab stock sheet supply stack, such force having at least a component in a direction relative to such tab stock sheet supply stack to prevent individual tab stock sheets in such stack from prematurely moving out of registered control of the top feed vacuum corrugated feed head assembly.

The invention, and its objects and advantages, will become more apparent in the detailed description of the preferred embodiments presented below.

BRIEF DESCRIPTION OF THE DRAWINGS

In the detailed description of the preferred embodiments of the invention presented below, reference is made to the accompanying drawings, in which.

DETAILED DESCRIPTION OF THE INVENTION

Figure 1:
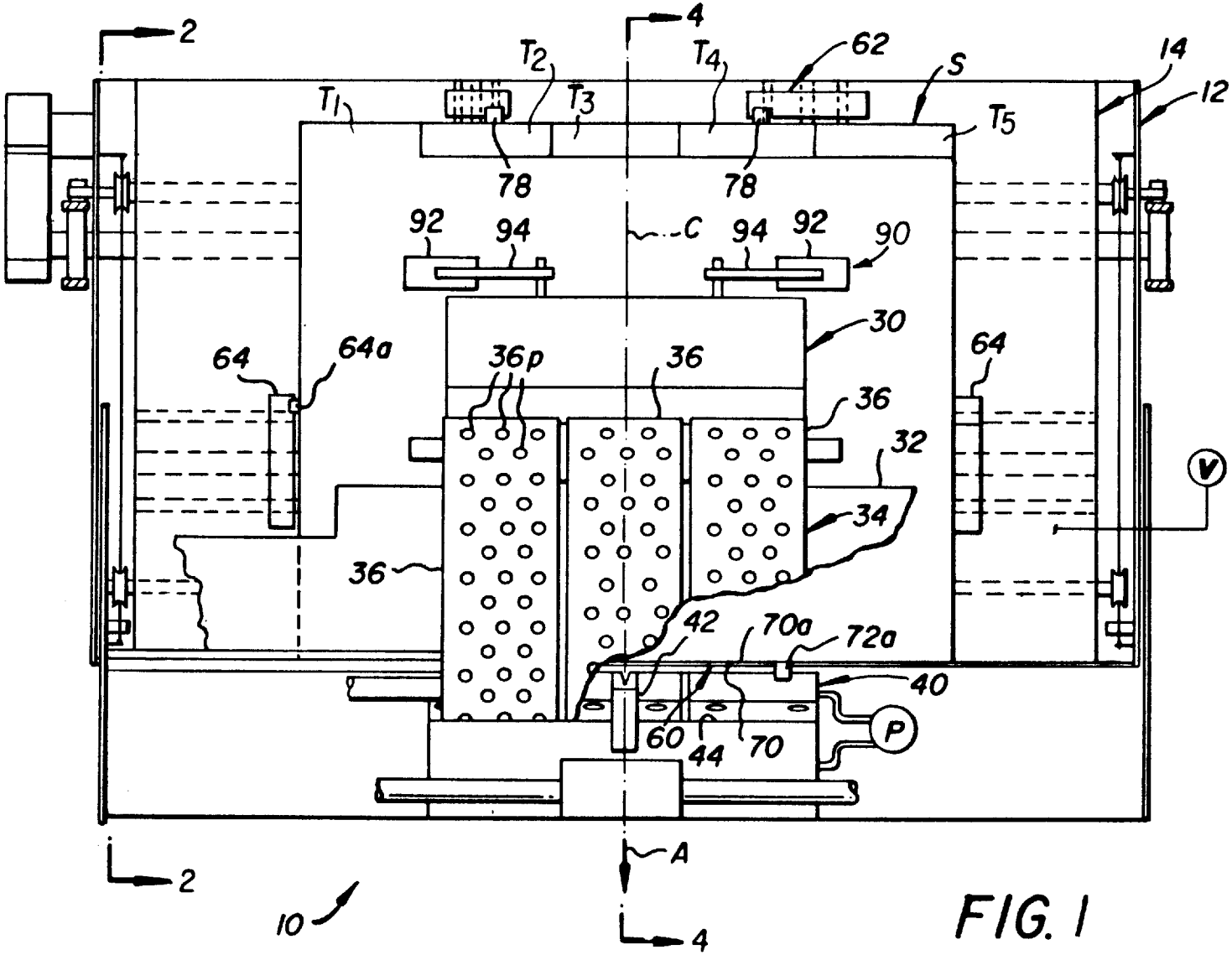
FIG. 1 is a top plan view of a top feed vacuum corrugated receiver sheet supply and feeding apparatus, including a first embodiment of an apparatus for facilitating handling of tab stock, according to this invention, with portions removed or broken away to facilitate viewing.
Figure 2:
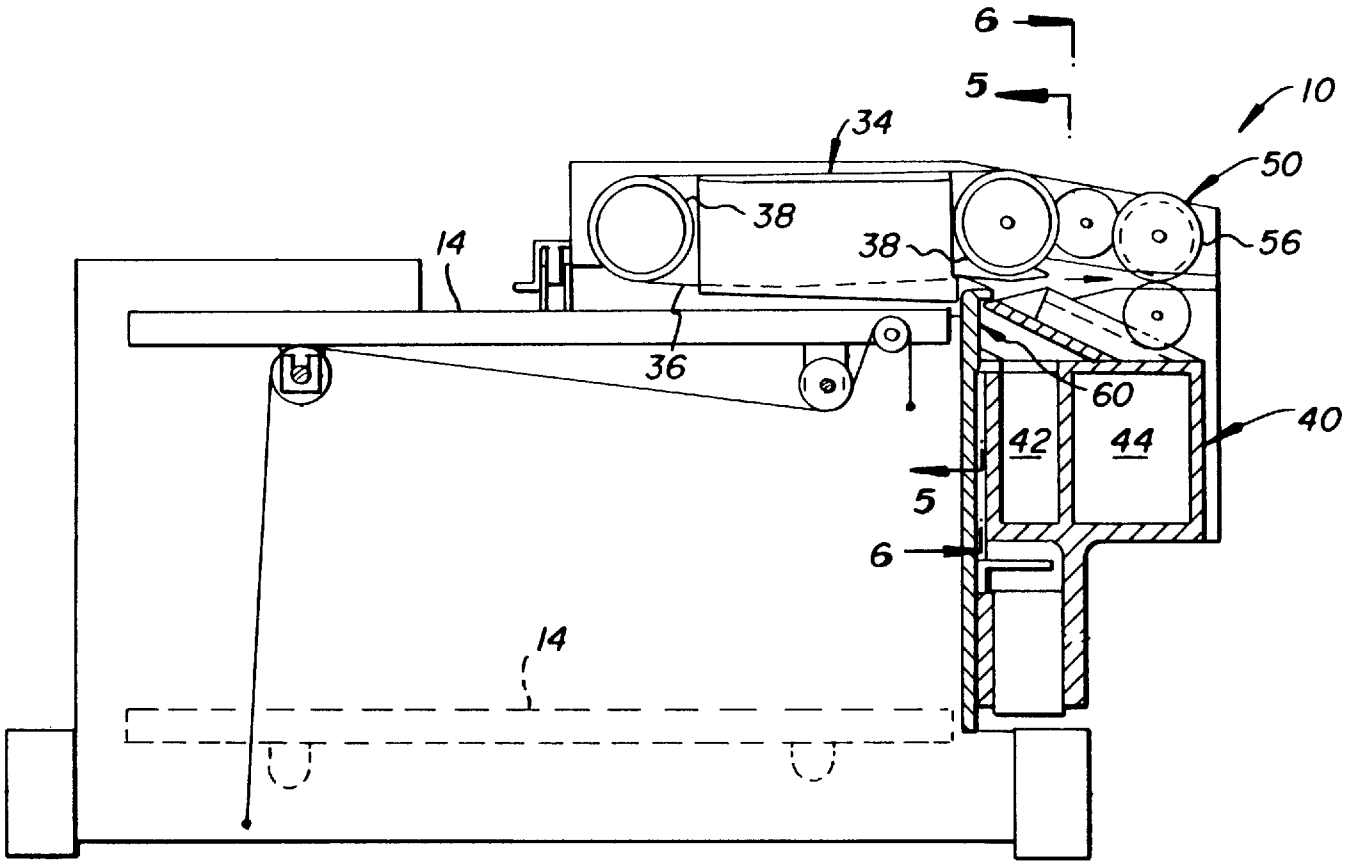
FIG. 2 is a side elevational view of a cross-section of the top feed vacuum corrugated receiver sheet supply and feeding apparatus of FIG. 1, taken along lines 2—2 of FIG. 1.
Figure 4:
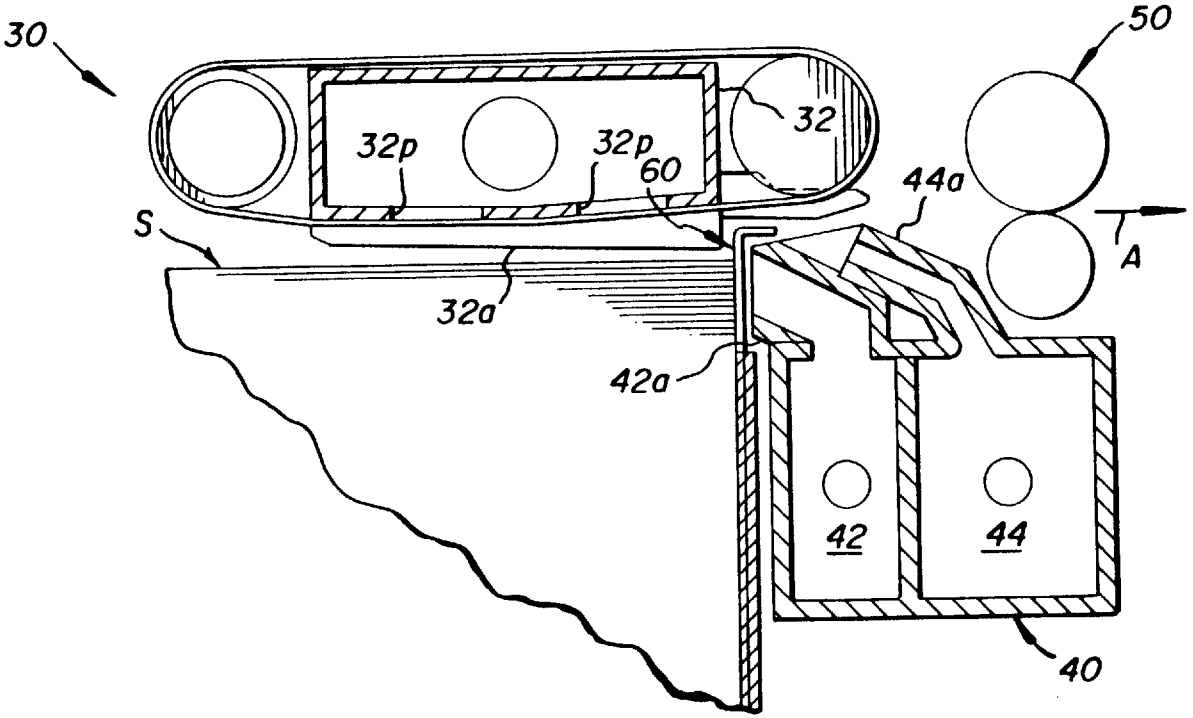
FIG. 4 is a side elevational view, on an enlarged scale and with portions removed, of a portion of the top feed vacuum corrugated receiver sheet supply and feeding apparatus particularly showing the feed head assembly thereof.

Referring now to the accompanying drawings, FIGS. 1, 2, and 4 generally show an exemplary top feed vacuum corrugated receiver sheet supply and feeding apparatus such as that disclosed in the aforementioned U.S. Pat. No. 5,344,133, for a reproduction apparatus of any well known type. Such top feed vacuum corrugated receiver sheet supply and feeding apparatus, designated generally by the numeral 10, is described herein only in such sufficient detail to enable a full and complete understanding of the instant invention. The top feed vacuum corrugated receiver sheet supply and feeding apparatus 10, which includes apparatus particularly for facilitating the handling of tab stock according to this invention, incorporates an open hopper 12 and an elevating platform 14 for supporting a stack of sheets. A sheet stack (designated by the letter S) supported on the platform 14 contains individual sheets suitable for serving as receiver sheets having reproductions formed thereon in a reproduction apparatus, such as a copier or printer for example.

Figure 3:
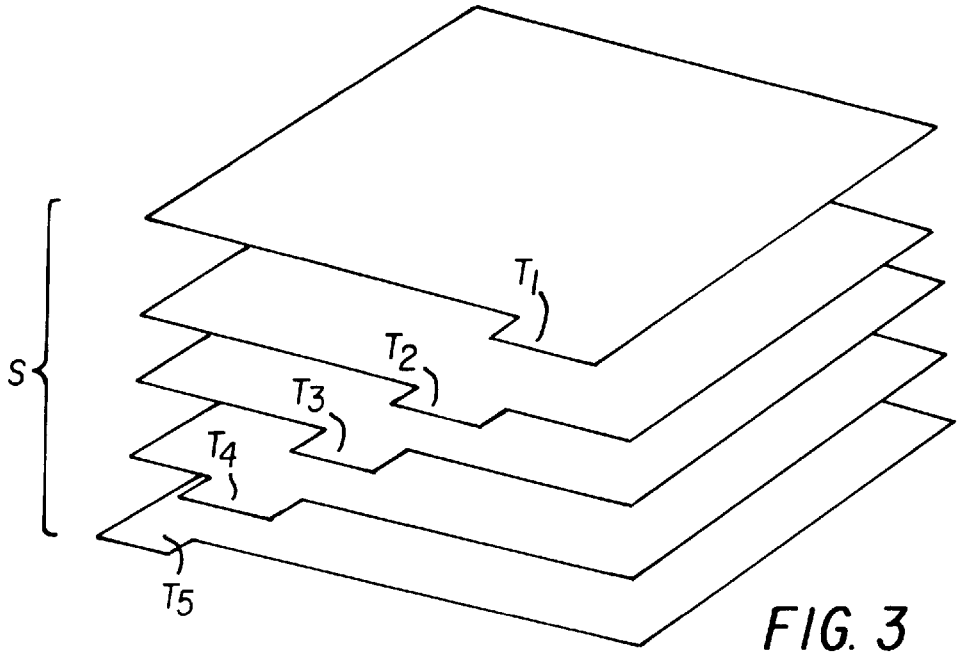
FIG. 3 is an exploded view, in perspective, of tabbed sheets of a tab stock sheet supply stack.

Sheets for receiving reproductions, or for separating or providing divisions in a copy set, may be selected from a wide variety of materials and sizes. Of particular relevance to this invention are tabbed sheets. Accordingly, the stack S is herein depicted as containing tab stock, although handling of other types of sheets may be similarly effected. The individual tabbed sheets of the tab stock sheet stack, as best be seen in the exploded view of FIG. 3, respectively have tabs $T_1$–$T_5$ spaced along a marginal edge of the stack. As such, although the marginal edge of the stack its self is even, the tabbed marginal edge of each sheet is not even.

The sheet stack supporting platform 14 is supported within the hopper 12 for substantially vertical elevational movement by a suitable lifting mechanism. The lifting mechanism serves to raise the platform 14 to an elevation for maintaining the topmost sheet in the stack S at a predetermined level during operation of the apparatus 10, and lower the platform to permit adding sheets thereto. In FIG. 2, the sheet stack supporting platform 14 is shown in its most elevated position in solid lines, and in its lowest position in phantom lines. Maintaining the topmost sheet at the predetermined level is accomplished by a sheet detecting switch (not shown) which controls the operation of the lifting mechanism to raise the platform 14 through a predetermined increment. On the other hand, lowering of the platform 14 is usually accomplished by some externally produced signal to bring the platform to its lowest position.

A sheet feed head assembly, generally designated by the numeral 30, is located in association with the hopper 12 so as to extend over a portion of the platform 14 in spaced relation to a sheet stack supported thereon. The sheet feed head assembly 30 includes a ported plenum 32 connected to a vacuum source V, and an air jet device 40 connected to a positive pressure air source P. As will be more fully explained hereinbelow, a positive pressure air jet from the device 40 levitates the top several sheets in the supported sheet stack S, vacuum at the plenum 32 is effective through its ports 32*p* (see FIG. 4) to cause the topmost levitated sheet from the stack to thereafter be acquired at the plenum for separation from the sheet stack. Additional positive pressure air jets from the device 40 assure separation of subsequent sheets from the acquired topmost sheet.

Figure 5:
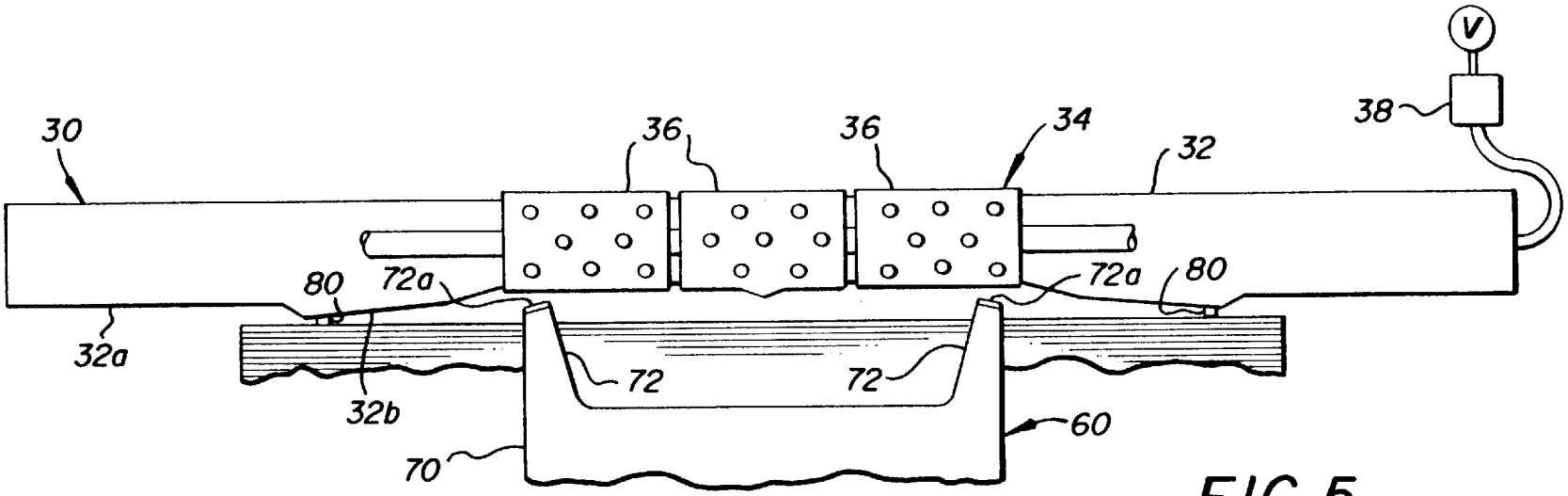
FIG. 5 is an end view, on an enlarged scale and with portions removed, of a portion of the receiver sheet supply and feeding apparatus, particularly showing the feed head assembly thereof, taken along the lines 5—5 of FIG. 2.
Figure 6:
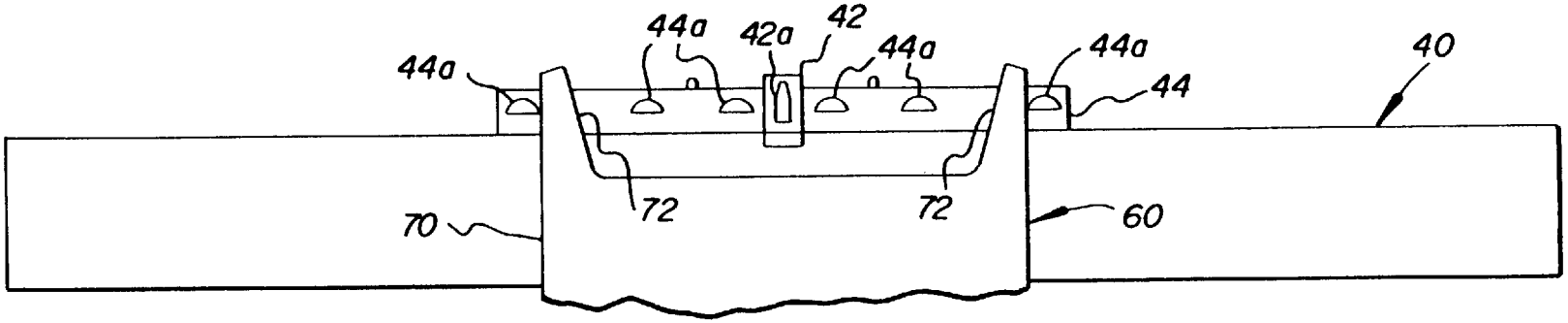
FIG. 6 is an end view, on an enlarged scale and with portions removed, of a portion of the receiver sheet supply and feeding apparatus, particularly showing the air supply jets, taken along the lines 5—5 of FIG. 2.

The lower surface 32*a* of the plenum 32 of the sheet feed head assembly 30 has a particularly configured shape (shown in FIG. 5) so as to provide for corrugation of an acquired sheet. As the top sheets in the supported sheet stack are levitated, the topmost sheet contacts the outer winged portions 32*b* of the surface 32*a*. A minimal pressure is exerted on the cross-track marginal edges of the sheet to help in forming a controlled corrugation to the sheet. This establishes a consistent spacing for the center portion of the sheet from the center portion of the plenum 32. As such, the access time for a sheet to be acquired at the plenum is repeatably consistent and readily predictable. The interactions of the plenum 32, the air jet device 40, and a front stop (designated by the numeral 60 and more fully described hereinbelow) assure that control over the sheet as it is acquired at the plenum is never lost. Further, corrugation of the sheet contorts the sheet in an unnatural manner. Since subsequent sheets are not subjected to the same forces, at the same time, as is the topmost sheet, such subsequent sheets are unable to contort in the same manner. Accordingly, the subsequent sheets are effectively separated from the topmost sheet as it is being acquired at the plenum.

If desired, a switch 80, for example a pressure or mechanically activated switch, may be attached to the plenum to detect when a sheet has been acquired. A signal provided by the switch on detection of sheet acquisition is utilized to control operation of various components of the sheet feed head assembly 30, such as timing of activations or setting of air flow levels, to optimize operation for a particular type (size) of sheet to be fed from the sheet supply and feeding apparatus 10.

The sheet feed head assembly 30 additionally includes a belt mechanism 34 for transporting an acquired sheet in a feed direction (designated by the arrow A in FIGS. 1, 2 and 4) away from the sheet stack S toward a downstream location. The belt transport mechanism 34 has a plurality of belts 36 entrained about rollers 38 to establish a closed loop path about the plenum 32. The lower runs of the belts 36 are in intimate contact with the lower surface 22*a* of the plenum 22 (see FIG. 5). The acquired sheet from the sheet stack S is effectively tacked to the belts by air pressure resulting from the application of vacuum in the plenum 32 through the plenum ports 32*p* and the belt ports 36*p*.

The belts 36 are selectively driven in a direction (counterclockwise in FIGS. 2 and 4) to remove the acquired sheet from the area above the sheet stack S and transport the sheet in the feed direction A along a travel path to a downstream transport, such as driven feed nip roller pair 50. Accordingly, the belts 36 are selectively driven so as to feed an acquired sheet such that the acquired sheet is transported from the sheet stack S and is thereafter available for any further processing, such as receiving a reproduction from a copier or printer, for example.

The hopper 12 incorporates a front stop 60, a rear stop 62 and side stops 64 arranged to engage the marginal edges of a sheet stack S supported on the platform 14 and accurately locate the sheet stack in register relative to the sheet feed head assembly 30. The front stop 60 additionally provides a lead edge guide for the topmost sheet in the sheet stack as it is removed from the stack for acquisition, and also serves as a retard mechanism for any sheets adhering to the topmost sheet as it is removed. The positive pressure air jet device 40 of the sheet feed head assembly 30 is located adjacent to the front stop 60 on the opposite side thereof from the sheet supporting platform 14. As noted above, the air jet device 40 is for the purpose of levitating the top sheets in the sheet stack S and separating subsequent sheets adhering to the topmost sheet when acquired for removal from the sheet stack. Further, one of the side stops 64 may include a leaf spring type loading device 64*a*. The loading device 64*a* exerts a force on the top portion of the sheet supply stack S to assure that the sheets therein are maintained against the opposite side stop for accurate positioning of the sheet supply stack relative to the feed head assembly 30.

The positive pressure air jet device 40 includes a first air jet arrangement 42 and a second air jet arrangement 44. The first air jet arrangement 42 incorporates a single nozzle 42*a* in flow communication with a source of positive pressure air P. The nozzle 42*a* is located substantially along the center line C (see FIG. 1) of the sheet stack S, in the cross-track direction, and is aimed at the location where the top of the sheet stack will be positioned by the sheet support platform 14. The single nozzle 42*a* directs a high pressure air stream at the sheet stack, in the center of the lead edge, to fluff the top several sheets in the stack to bring the topmost sheet into association with the sheet feed head assembly 30 where it can be acquired, by vacuum, at the plenum 32.

The top several sheets in the sheet stack S begin separation between each sheet and the topmost sheet rises, along its center line C, to a controlled height above the sheet stack. The positive air flow through the nozzle can be pulsed from a low to a high flow rate, or may be left on at a high flow rate. Once the sheets have started to levitate (fluff up) in the center, the topmost sheet will rise to the outside corrugation points of the plenum 32. The air flow going into the stack will ideally be allowed to proceed through the stack out the rear thereof, with some finding its way out through the sides of the stack.

The second air jet arrangement 44 incorporates a plurality of nozzles 44*a* (preferably six in number) in common flow communication with the source of positive pressure air P (or, alternatively, a second separate source of pressurized air). The nozzles 44*a* are aimed at the location where the top of the sheet stack will be positioned by the sheet support platform 14, and slightly downstream of the aim point for the first air jet nozzle 42*a* (see FIG. 4). The purpose of the second air jet arrangement 44 is to separate any sheets adhering to the topmost sheet acquired by the sheet feed head assembly 30 for removal and transport from the sheet stack S.

As discussed above, it has been found that subsequent sheets adhering to the acquired topmost sheet are not able to form the corrugations caused by the different ribs and bends of the lower surface 32*a* of the plenum 32 (as does the topmost sheet when properly acquired). Thus, pockets are formed between the topmost sheet and any subsequent adhering sheets. The air stream provided by the second air jet arrangement 44, by its location and aim, is directed into the pockets and forces the subsequent sheets back down to the sheet stack S. As such, subsequent sheets are in effect retarded and thus substantially prevented from being fed with the acquired topmost sheet, as a multi-feed condition.

Turning now to a more detailed description of the front stop 60, the front stop comprises a plate 70 having a surface 70*a* against which the lead edge of the stack of sheets S is positioned to accurately locate the stack, in the sheet feed direction, relative to the sheet feed head assembly 30. The plate 70 has a pair of upstanding fingers 72. The fingers 72 serve to maintain the in-track position of the sheets of the stack as the sheets are levitated by the first air jet arrangement 42. That is, the topmost sheet and a number of subsequent sheets levitate, but are kept from moving forward relative to the sheet stack S by the fingers 72. The tops 72*a* of the fingers are configured to have an angle substantially equal to the corrugation of the plenum surface 32*a* respectively adjacent thereto. This establishes a restricted sheet passage (see FIG. 5) through which only a properly corrugated sheet can pass. Any subsequent sheets adhering to the topmost acquired sheet will not have the proper corrugation, as explained above, and will be blocked by the fingers 72 so that they will not be able to be transported away from the sheet stack. If not for the fingers, the subsequent sheets could be dragged forward during transport of the topmost sheet by the belts 36 creating a multi-feed condition or incorrectly locating (mis-registering) the subsequent sheets for the beginning of the next feed cycle. The spacing of the fingers 72 is selected to enable substantially free positive air flow from the first and second air jet arrangements 42, 44 therebetween.

As noted above, the hopper 12 also incorporates a rear stop 62. The rear stop 62 is necessary to prevent sheets levitated from the sheet stack S by the first air jet arrangement 42 from moving toward the rear (relative to the sheet stack) by the positive air pressure exerted on the sheets. The rear stop 62 is adjustably mounted (on guide rods for example) for selective positioning in the sheet feed direction A so as to positively engage the rear edge of a sheet stack, of any of a variety of dimensions in the sheet feed direction, supported on the platform 14 and engaged at its lead edge with the front stop 60. The rear stop 62 is manually movable along guide rods to a selected position corresponding to a dimension of the sheet stack in the in-track direction (measured from the front stop 60). If desired, the rear stop 62 may include a loading device 78, such as a leaf spring, for exerting pressure on the top portion of the sheet stack S (and the levitated sheets) to assure that the sheets are maintained in register against the front stop 60.

The levitated sheets are maintained by the rear stop in their position relative to the sheet stack against the fingers 72 of the front stop 60. However, it is important that the positive air flow from the air jet device 40 between the levitated sheets be allowed to escape from the rear of the sheets. If the air flow were to be restricted, the corrugation of the topmost sheet will become unpredictable and thus the efficiency in acquiring the sheet by the sheet feed head assembly 30 will be substantially reduced. Accordingly, the rear stop 62 is formed as two substantially identical assemblies spaced apart on opposite sides of the supported sheet stack center line C. Of course, a single assembly with a large opening spanning the area through which the air flow can pass substantially unrestricted is also suitable for use with the apparatus 10.

Figure 8:
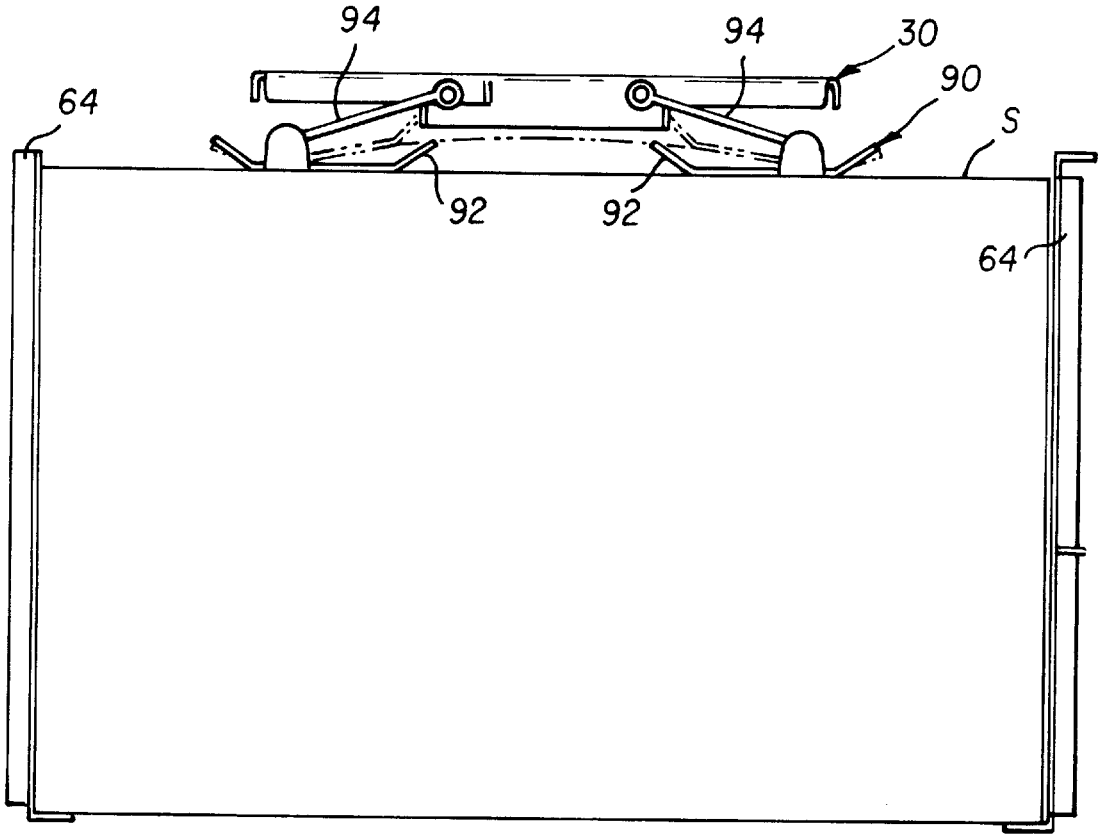
FIG. 8 is a rear elevational view of the first embodiment of apparatus for facilitating the feeding of tab stock shown in FIG. 7.

The present invention provides apparatus, designated generally by the numeral 90, for facilitating handling tab stock with the sheet supply and feeding apparatus 10 described above. The apparatus 90 of the preferred embodiment (best seen in FIGS. 1, 7, and 8) includes a pair of weighted members 92 adapted to rest on the top of the tab stock sheet supply stack S supported on the platform 14. Of course, any desired predetermined number of weighted members are suitable for use with the apparatus 90 according to this invention. The weighted members 92, configured generally in the shape of skis, are respectively connected by arms 94 to the feed head assembly 30 at the rear portion thereof. The respective arms 94 are pivotably connected at one end to the feed head assembly 30 and at the other end to a weighted member. As such, the weighted members 92 respectively extend from the feed head assembly 30 and readily follow the top of the tab stock sheet supply stack S as the topmost tabbed sheet is acquired by the feed head assembly. Specifically, FIG. 8 shows the tab stock sheet supply stack S with the weighted members 92 in engagement with the topmost sheet in solid lines before acquisition by the feed head assembly 30, and in phantom lines after the topmost sheet has been acquired by the feed head assembly.

Figure 7:
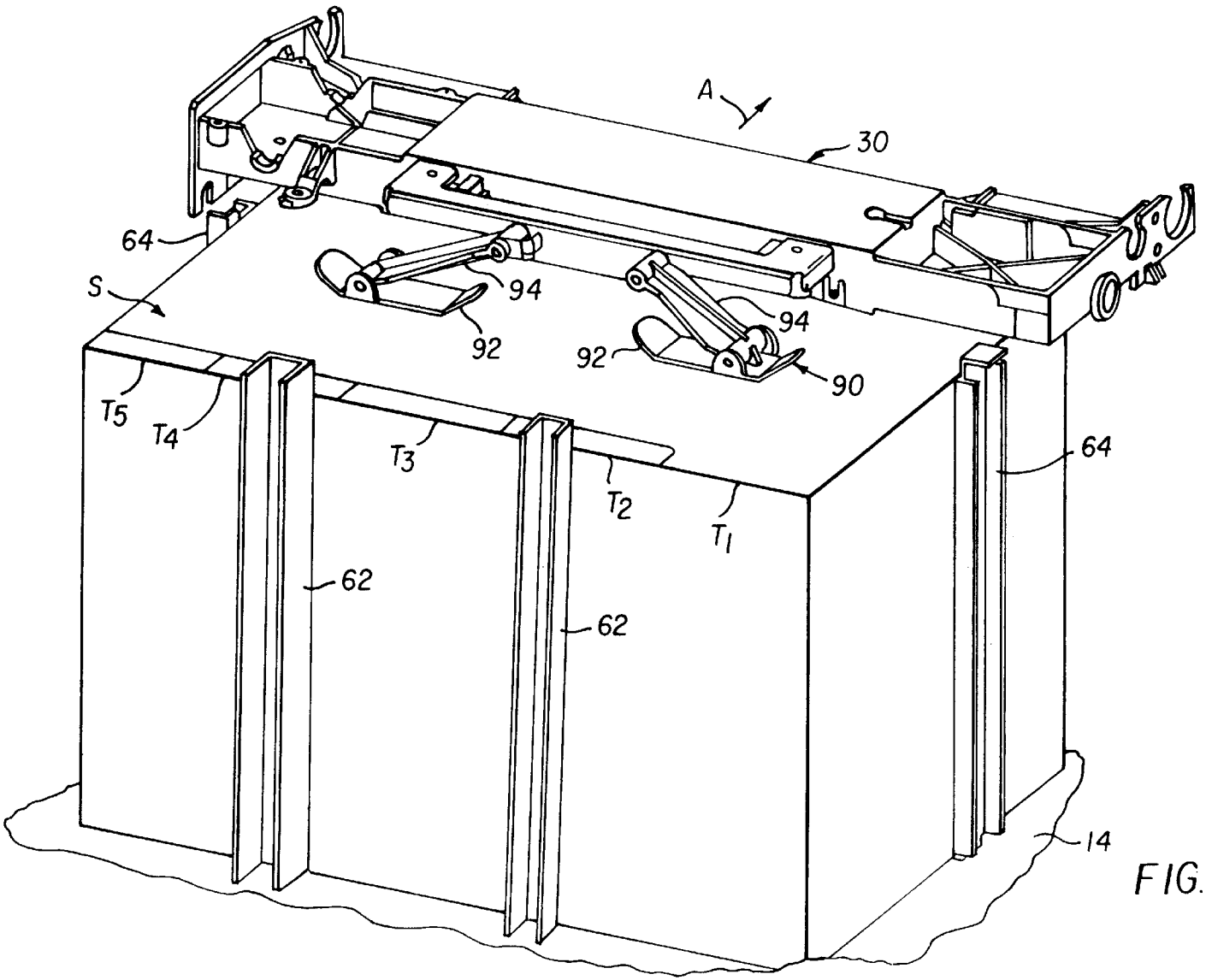
FIG. 7 is a view, in perspective, of the receiver sheet supply and feeding apparatus, particularly showing a first embodiment of apparatus for facilitating the feeding of tab stock.

The location of the weighted members 92 is selected such that they respectively contact the tab stock sheet supply stack S upstream, in the direction of sheet feed (represented by the arrow A) from the sheet supply stack, of the feed head assembly 30 (see FIG. 7). The weighted members 92 apply a force to the tab stock sheet supply stack S, such force having at least a component in a direction relative to such tab stock sheet supply stack to prevent individual tabbed sheets in such stack from prematurely moving out of registered control of the feed head assembly 30. That is to say, as explained above, the separating air jets of the pressurized air jet device 40 direct a positive flow of air at the top portion of the sheet supply stack S in a direction having a component opposite to the direction of sheet feed by the feed head assembly 30. Further, the rear marginal edge of the sheet supply stack S is not completely restrained by the rear stop 62 due to the unevenness resulting from the tab portions $T_1$–$T_5$ of the individual tabbed sheets. Thus, when the topmost sheet is acquired by the feed head assembly 30, individual tabbed sheets beneath the topmost sheet will be urged by the positive air flow in the direction opposite the feed direction. Accordingly, the weighted members 92 are arranged to prevent such sheets from moving out of the proper area for later registered acquisition by the feed head assembly which otherwise may lead to failure to subsequently acquire such sheets, or in misregistration of acquired sheets.

The weighted members 92 are arranged to act on the tab stock sheet supply stack S to maintain the individual top sheets, below the acquired sheet, in frictional engagement, at least over a portion thereof. As such, the weighted members confine the volumetric space, and thus the space for the air flow, between the acquired sheet and the subsequent sheets to increase the pressure on the stack beneath the acquired sheet. The increased pressure provides a significant friction force on the sheets in the sheet stack sufficient to counter the force of the positive air flow urging the sheets in the direction opposite to the feed direction. At the same time, the weighted members 92 will enable the acquired sheet to assume the desired corrugated shape and allow the positive air flow to pass through the sheet stack and out through the rear stop 62. As a result, the individual tabbed sheets will be prevented from moving in the direction opposite to the feed direction, while the effectiveness of the positive air flow for sheet separation will not be negatively impacted.

Figure 9:
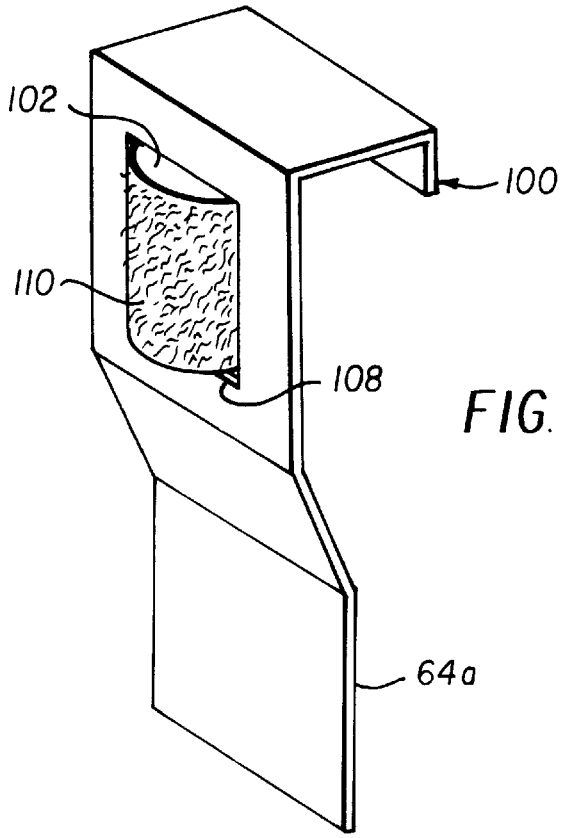
FIG. 9 is a view, in perspective, of the receiver sheet supply and feeding apparatus, particularly showing a second, alternate, embodiment of apparatus for facilitating the feeding of tab stock.
Figure 10:
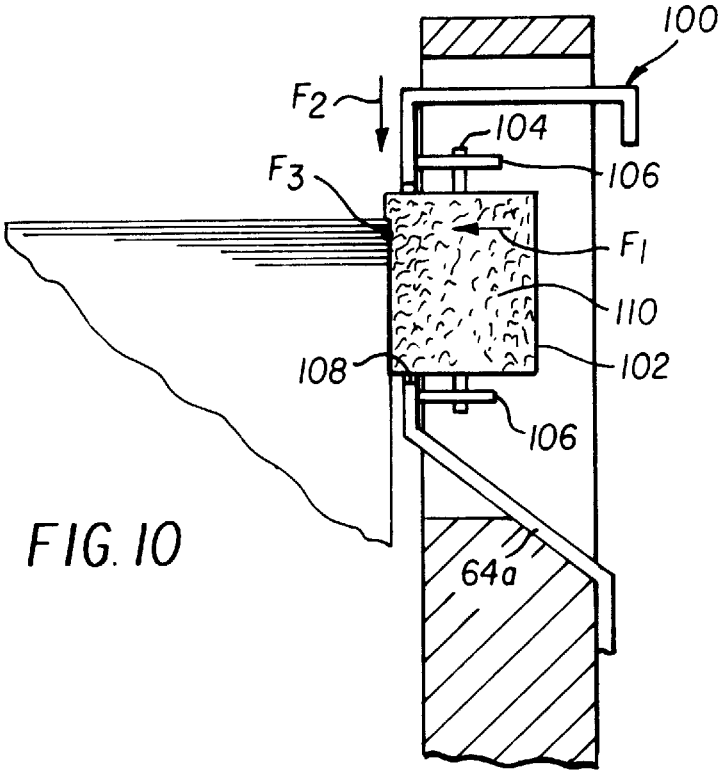
FIG. 10 is a rear elevational view of the second embodiment of apparatus for facilitating the feeding of tab stock shown in FIG. 9.

An alternate embodiment for the present invention provides apparatus, designated generally by the numeral 100, for facilitating handling tab stock with the sheet supply and feeding apparatus 10 described above. The apparatus 100 (best shown in FIGS. 9 and 10) includes a member in the configuration of a roller 102 associated with the side stop spring 64*a*. The roller 102 is mounted for free rotation on a spindle 104 supported by flanges 106 extending from the side stop spring 64*a* adjacent to an opening 108 therein. The circumference of the roller 102 is covered with a plush material 110 having fibers extending from the surface at an angle to provide greater resistance to movement of a contacted object in one direction than in the opposite direction (commonly referred to as a "one way" plush material).

The spindle 104 is located such that a portion of the circumference of the roller 102 extends through the opening 108 into contact with the top portion of the tab stock sheet supply stack S. The plush material 110 covering the circumference of the roller 102 assures that the roller applies a force to the top portion of the sheet supply stack having the three components designated in FIG. 10 by the arrows $F_1$, $F_2$, and $F_3$. The force component $F_1$ is directed at the top portion of the sheet supply stack so as to urge such portion toward the opposite side stop, and the force component $F_2$ is directed normal to the top portion of the sheet supply stack so as to urge such portion downwardly toward one another to provide a friction force therebetween. The force component $F_3$ of the roller 102 is directed at the top portion of the sheet supply stack (into the plane of FIG. 10) so as to oppose movement of any sheets away from the feed head assembly 30 in the direction opposite to feeding. Due to the "one way" nature of the material on the circumference of the roller 102, the topmost sheet to be fed by the feed head assembly in the feed direction will be substantially uninhibited even though movement of subsequent sheets in the opposite direction is opposed.

As will be appreciated, during feeding of individual tabbed sheets from the sheet supply stack S, the roller 102 will not rotate about the axis of the spindle 104. This is due to the fact that the majority of sheets in contact with the circumference of the roller at any particular time are not being fed and will thus prevent roller rotation. However, as the last sheet in the stack is fed, the roller 102 will rotate about the spindle axis since there are no stationary sheets in contact therewith to counter the rotational force exerted thereon by the fed sheet. Rotation of the roller 102 serves to bring a new area of the roller circumference into association with the opening 108 of the side stop spring 64*a*. As such, when the next stack of sheets is loaded on the platform 14 of the apparatus 10, it will be engaged by the new area of the roller circumference. In this manner, the useful life of the roller 102 is substantially increased.

It should be noted that the apparatus 90 or 100, according to this invention, may be arranged to exhibit operating parameters which can eliminate the need for the rear stop 60 of the sheet supply and feeding apparatus 10. This will simplify the construction of the apparatus and conserve on the space requirements thereof.

The invention has been described in detail with particular reference to preferred embodiments thereof, but it will be understood that variations and modifications can be effected within the spirit and scope of the invention as set forth in the claims.

What is claimed is:

1. In an apparatus for feeding sheets seriatim from a sheet supply stack including a sheet feed head assembly having a plenum, a vacuum source in flow communication with said plenum, and means associated with said plenum for urging a sheet acquired by vacuum in a sheet feeding direction away from the sheet supply stack, means for supporting the sheet supply stack so as to maintain the topmost sheet in such stack at a predetermined level in spaced relation with respect to said urging means of said sheet feed head assembly, first positive air supply means for directing a flow of air at the sheet supply stack to levitate the top several sheets in the supply stack to an elevation enabling the topmost sheet to be acquired by vacuum from said sheet feed head assembly plenum, and second positive air supply means for directing a flow of air at an acquired sheet to assure separation of any subsequent sheets in the sheet supply stack adhering such topmost sheet, an apparatus for facilitating handling of sheets, including tab stock, in such sheet supply stack comprising:

at least one weighted member, adapted to rest on the top of a sheet supply stack on said platform over an area of said tab stock at a portion of said sheet supply stack which excludes tabs of said tab stock, so as to apply a substantial force to said sheet supply stack, such force having at least a component of sufficient magnitude in a direction relative to such sheet supply stack to prevent individual sheets in such supply stack from prematurely moving in a direction opposite to the sheet feed direction out of registered control of said feed head assembly while confining the volumetric space, and thus the space for air flow, between the acquired sheet and subsequent sheets in said supply stack to increase the pressure on such supply stack beneath the acquired sheet, such increased pressure providing a significant friction force on sheets in such supply stack sufficient to counter the force of the positive air flow urging sheets in the direction opposite to the feed direction.

2. The sheet handling facilitating apparatus of claim 1 wherein said at least one weighted member is pivotably connected to said feed head assembly to extend therefrom to contact said sheet supply stack upstream, in the direction of sheet feed from said sheet supply stack, of said feed head assembly.

3. The sheet handling facilitating apparatus of claim 1 including a pair of weighted members, respectively pivotably connected to said feed head assembly to extend therefrom and rest on the top of a sheet supply stack on said platform, said pair of weighted members being respectively located so as to contact said sheet supply stack upstream, in the direction of sheet feed from said sheet supply stack, of said feed head assembly.

* * * * *